US007090560B2

(12) United States Patent
Billig

(10) Patent No.: US 7,090,560 B2
(45) Date of Patent: Aug. 15, 2006

(54) SYSTEM AND METHOD FOR DETECTING ABRASIVE ARTICLE ORIENTATION

(75) Inventor: Daniel A. Billig, Maplewood, MI (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/900,714

(22) Filed: Jul. 28, 2004

(65) Prior Publication Data

US 2006/0025045 A1 Feb. 2, 2006

(51) Int. Cl.

| | |
|---|---|
| ***B24B 49/00*** | (2006.01) |
| ***B24B 51/00*** | (2006.01) |
| ***B24B 1/00*** | (2006.01) |
| ***B24B 21/00*** | (2006.01) |
| ***G06F 19/00*** | (2006.01) |

(52) U.S. Cl. ..... 451/5; 451/6; 451/8; 451/9; 451/41; 451/296; 451/297; 451/298; 451/299; 451/300; 451/301; 451/302; 451/303; 451/304; 451/305; 451/306; 451/307; 451/308; 451/309; 451/310; 451/311; 700/164; 700/175; 700/179; 700/177

(58) Field of Classification Search ..... 451/5–6, 451/8–9, 41, 296–311; 700/164, 175, 179, 700/177

See application file for complete search history.

(56) References Cited

U.S. PATENT DOCUMENTS

| | | | |
|---|---|---|---|
| 3,053,020 | A | 9/1962 | Bratton |
| 3,295,138 | A | 12/1966 | Nelson |
| 3,552,067 | A | 1/1971 | Przygocki |
| 3,753,093 | A | 8/1973 | Gardner et al. |
| 3,872,627 | A | 3/1975 | Schuster |
| 4,178,721 | A | 12/1979 | Evans |
| 4,205,490 | A | 6/1980 | Evans |
| 4,215,516 | A | 8/1980 | Huschle et al. |
| 4,262,455 | A | 4/1981 | Rettew |
| 4,478,011 | A | 10/1984 | Russell |

(Continued)

FOREIGN PATENT DOCUMENTS

| | | |
|---|---|---|
| GB | 1 352 172 | 5/1974 |

(Continued)

OTHER PUBLICATIONS

D. Billig, "Abrasive Article Splicing System and Methods", U.S. Appl. No. 10/900,853, filed Jul. 28, 2004.

(Continued)

*Primary Examiner*—Joseph J. Hail, III
*Assistant Examiner*—Bryan R. Muller

(57) ABSTRACT

Systems and methods control abrading operations of an abrading machine by sensing characteristics of an abrading article installed on the abrading machine. When a problem is discovered by sensing the article, appropriate actions may be taken. As one example, the abrading article may be sensed to determine whether the abrading article has been installed with an abrasive side facing the wrong direction. An alert allows an operator to reinstall the article. As another example, the abrading article may be sensed to determine whether splicing tape is present to hold two pieces of abrading tape together. The article may be advanced until the splicing tape is beyond an abrading zone. As another example, the abrading article may be sensed to determine whether the abrading article has stopped moving while the article drive is advancing because the article has broken. An alert allows an operator to repair the break. As yet another example, the abrading article may be sensed to determine whether it is the appropriate grade. An alert allows the article grade to be corrected.

14 Claims, 8 Drawing Sheets

U.S. PATENT DOCUMENTS

| | | | | |
|---|---|---|---|---|
| 4,583,669 | A | | 4/1986 | Sirkis |
| 4,589,233 | A | | 5/1986 | Parekh et al. |
| 4,665,624 | A | | 5/1987 | Wodis |
| 4,742,406 | A | | 5/1988 | Turuda |
| 4,999,953 | A | | 3/1991 | Kinugawa et al. |
| 5,012,989 | A | | 5/1991 | Whyte, Jr. et al. |
| 5,109,637 | A | | 5/1992 | Calafut |
| 5,152,917 | A | | 10/1992 | Pieper et al. |
| 5,229,585 | A | | 7/1993 | Lemberger et al. |
| 5,316,812 | A | | 5/1994 | Stout et al. |
| 5,342,645 | A | | 8/1994 | Eisele et al. |
| 5,383,014 | A | | 1/1995 | Nowak et al. |
| 5,394,654 | A | | 3/1995 | Shimbara et al. |
| 5,452,150 | A | | 9/1995 | Henneberger et al. |
| 5,486,835 | A | | 1/1996 | Hock |
| 5,514,028 | A | | 5/1996 | Ali et al. |
| 5,556,185 | A | * | 9/1996 | Bungo et al. ..... 353/26 R |
| 5,584,589 | A | | 12/1996 | Adkins et al. |
| 5,643,044 | A | | 7/1997 | Lund |
| 5,661,616 | A | | 8/1997 | Tran et al. |
| 5,710,069 | A | | 1/1998 | Farkas et al. |
| 5,725,421 | A | * | 3/1998 | Goers et al. ..... 451/303 |
| 5,791,969 | A | | 8/1998 | Lund |
| 5,840,141 | A | | 11/1998 | Korbel |
| 5,846,835 | A | | 12/1998 | Sisbarro et al. |
| 5,874,678 | A | | 2/1999 | Yamamoto |
| 5,904,608 | A | * | 5/1999 | Watanabe ..... 451/5 |
| 5,913,716 | A | | 6/1999 | Mucci et al. |
| 5,977,782 | A | | 11/1999 | Kordecki |
| 6,136,043 | A | * | 10/2000 | Robinson et al. ..... 8/485 |
| 6,264,533 | B1 | | 7/2001 | Kummeth et al. |
| 6,369,842 | B1 | | 4/2002 | Abramsohn |
| 6,406,577 | B1 | | 6/2002 | Benedict et al. |
| 6,439,962 | B1 | | 8/2002 | Ato |
| 6,572,696 | B1 | | 6/2003 | Berenguer et al. |
| 6,612,902 | B1 | | 9/2003 | Boyd et al. |
| 6,692,895 | B1 | | 2/2004 | Huang et al. |
| 2002/0061722 | A1 | | 5/2002 | Kondo et al. |
| 2002/0186370 | A1 | | 12/2002 | Roesner et al. |
| 2003/0022598 | A1 | | 1/2003 | Muilenburg et al. |

FOREIGN PATENT DOCUMENTS

| | | |
|---|---|---|
| WO | WO 93/12911 | 7/1993 |

OTHER PUBLICATIONS

D. Billig, "Abrasive Article Detection System and Methods", U.S. Appl. No. 10/990,919, filed Jul. 28, 2004.

D. Billig, "Grading System and Method for Abrasive Article", U.S. Appl. No. 10/900,882, filed Jul. 28, 2004.

U.S. Appl. No. 10/900853, filed Jul. 28, 2004, entitled "Abrasive Article Splicing System and Methods." first-named invetor Daniel A. Billig, attorney case number 60032US002.

U.S. Appl. No. 10/900919, filed Jul. 28, 2004, entitled "Abrasive Article Detection System and Method," first-named inventor Daniel A. Billig, attorney case number 60032US002.

U.S. Appl. No. 10/900862, filed Jul. 28, 2004, entitled "Grading System and Method For Abrasive Article," first-named inventor Daniel A. Billig, attorney case number 60033US002.

* cited by examiner

SYSTEM AND METHOD FOR DETECTING ABRASIVE ARTICLE ORIENTATION

TECHNICAL FIELD

The present invention is related to the control of abrading operations of an abrading machine. More particularly, the present invention is related to controlling the abrading operations by sensing information about an abrading article installed on the abrading machine.

BACKGROUND

Abrading operations such as micro-finishing are often a vital step when manufacturing products. Abrading operations refer to the application of an abrasive to a workpiece. Abrading operations are typically performed to create a finer finish and/or to remove defects from a workpiece. As used herein, the term "workpiece" means a substrate whose surface is to be modified. Abrasive articles have long been used to grind, dimension, clean, polish, or otherwise refine the surface of substrates (workpieces). Suitable workpieces include but are not limited to those of metal, wood, plastic, composite, ceramic, and/or combinations. For example, many components of engines must be abraded to ensure proper operation and eliminate engine failures that would otherwise be caused. Camshafts, crankshafts, and transmission shafts are examples of such engine components. These engines are employed in automobiles, trucks, agricultural equipment, ships, boats, etc.

These abrading operations are performed by an abrading machine that utilizes an abrading article as an abrasive. The abrading article may be of various forms depending upon the particular purpose of the abrading operations. Abrasive articles generally fall into but are not limited to three categories: bonded abrasives, nonwoven abrasives, and coated abrasives. All of these categories contain abrasive particles secured in a binder. The term "abrasive particle" means a particle having sufficient hardness to alter the surface of a workpiece. The term "abrading" means the activity or process by which a workpiece is modified by inducing relative motion between an abrasive article and the workpiece. The term "coated abrasive backing" means the sheet-like member onto which abrasive particles are adhered by a binder. Examples of an abrading article include film, paper, or cloth having an abrasive coating on at least one side and abrading articles also include structured abrasives such as the Trizact abrasive from 3M of St. Paul, Minn. The classification of the abrasive coating is indicated by a grade assigned to the abrading article such that the abrading article is selected for a particular abrading operation by reference to its grade. As used herein, abrading article includes all grades or abrasiveness.

In regards to engine components finishing, typically the abrading article extends from a reel or winder at a source area of the abrading machine, through an abrading zone where a workpiece that is to be abraded is positioned, and then onward to a collection area. The abrading article is applied by the machine to the workpiece within the abrading zone as the workpiece rotates or otherwise moves in relation to the article. The abrading article is advanced by the machine as portions of the abrading article become worn. Eventually, the amount of abrading article on the reel or winder at the source area is depleted and a new reel or winder of article must be installed such as by splicing the new article to the end of the previous article.

Installing the article on this type of abrading machine is a largely manual task that is vulnerable to human error. One example of an error is installing the article with the abrasive side facing the wrong direction so that the abrasive is never brought into contact with the workpiece. This can occur because it can be difficult to distinguish the abrasive side from the non-abrasive side. When this occurs, any workpiece that is abraded with the article is not abraded properly and may be faulty as a result. Furthermore, if the error is not detected, many workpieces may be improperly abraded until the article is depleted and another reel is installed. Furthermore, the next several reels may be installed backwards as well if the installer does not realize a mistake has been made.

When the new article is spliced onto the end of the existing article, the connection of the two ends is often done using splicing tape. Splicing tape creates the potential for improper abrading due to the area of the article where the splicing tape is present being applied to the workpiece. Thus, an operator must ensure that the splicing tape is advanced beyond the abrading zone prior to the article being applied to the workpiece, and this presents another instance where human error may lead to faulty workpieces.

Another issue that occurs on occasion results from the abrasive article breaking when being applied to a workpiece. When this occurs, any subsequent attempts to abrade workpieces will fail because the article is no longer properly held in place on the workpiece by the machine. An operator must intervene by halting the abrading machine and re-feeding the article through the machine prior to the abrading operations continuing. Conventional systems attempt to detect a broken article by utilizing a mechanical flag in contact with the article that moves when the article moves and that breaks a beam of light once moved to register whether the article has moved. However, this flag system is prone to errors due to residue causing the flag to resist movement and due to the flag occasionally requiring an increment of movement to break the beam that is larger than the appropriate increment of article movement. Accordingly, the operator must continue to monitor the machines to determine whether the article has broken, and this also presents an instance where human error may lead to faulty workpieces and/or inefficiencies.

Abrading often involves multiple stages, where the workpiece is moved from one abrading machine to the next with each abrading machine applying a finer grade abrading article to the workpiece. Abrading machines in close proximity often utilize different grades of article, and the operator who installs the article must install the correct grade on a particular machine to maintain the proper sequence of abrading. This situation gives rise to yet another opportunity for human error to result in faulty workpieces due to the operator installing the improper grade of article.

What is desired in the industry is an increased user friendly system for finishing workpieces, including engine components.

SUMMARY

Embodiments of the present invention address these issues and others by providing methods and systems that control the abrading operations by sensing an abrading article installed on an abrading machine. Sensing of the abrading article allows for a determination of whether the article is installed with the abrasive side facing the wrong direction so as to control whether abrading operations may begin. Sensing of the abrading article allows for a determination of whether splicing tape is present in the abrading zone so as to control whether abrading operations may proceed without advancing the article. Sensing of the abrading article allows for a determination of whether the article has stopped moving because it is broken so as to control whether the abrading operations may proceed. Furthermore, sensing of the abrading article allows for a determination of the grade of article that is installed so as to control whether abrading operations may begin.

One embodiment is a system for controlling an abrading operation by detecting whether an abrading article is installed on an abrading machine with an abrasive side of the abrading article facing an appropriate direction. The system includes a sensor that is aimed toward the abrading article installed on the abrading machine and that receives a reflection from a first side of the abrading article to produce an input signal value that varies depending upon whether the first side is the abrasive side. The sensor includes logic that analyzes the input signal value in relation to a reference signal value and that produces an output signal having a value determined by a result of the comparison. A controller maintains the abrading machine in an active or inactive state and maintains an alert in an active or inactive state. The alert is indicative of the abrasive side of the abrading article facing an inappropriate direction. The controller receives the output signal and activates the abrading machine from an inactive state while maintaining the alert in the inactive state when the output signal value indicates that the abrasive side is facing the appropriate direction. The controller activates the alert from the inactive state while maintaining the abrading machine in the inactive state when the output signal value indicates that the abrasive side is not facing the appropriate direction.

Another embodiment is a method for controlling an abrading operation based on whether an abrasive side of an abrading article is facing an appropriate direction. The method involves sensing a reflection from a first side of the abrading article installed on an abrading machine to produce an input signal value that varies depending upon whether the first side is the abrasive side. The input signal value is compared to a reference signal value to determine whether the abrasive side is facing the appropriate direction. When it is determined that the abrasive side is facing the appropriate direction, an alert that is indicative of the abrading article being installed with the abrasive side facing an in appropriate direction is maintained in an inactive state while the abrading machine is activated from an inactive state. When it is determined that the abrasive side is not facing the appropriate direction, the abrading machine is maintained in the inactive state while the alert is activated from the inactive state.

DETAILED DESCRIPTION

Embodiments of the present invention provide for sensing of abrading article installed on an abrading machine so as to control the abrading machine and related alert(s) to operators. The abrading article may be sensed to determine whether it is installed with the abrasive facing the appropriate direction, whether splicing tape is within the abrading zone, whether the abrading article has broken, and whether the abrading article is the appropriate grade. The abrading operation may be controlled based upon the result of sensing the article, such as to prevent abrading from starting and to send the proper alert if the abrading article is installed backwards, if the abrading article is broken, and/or if the abrading article is a wrong grade. Furthermore, the abrading operation may be controlled to advance the abrading article by an amount large enough to move the splicing tape out of the abrading zone prior to beginning abrading if the splicing tape is detected.

Figure 1:
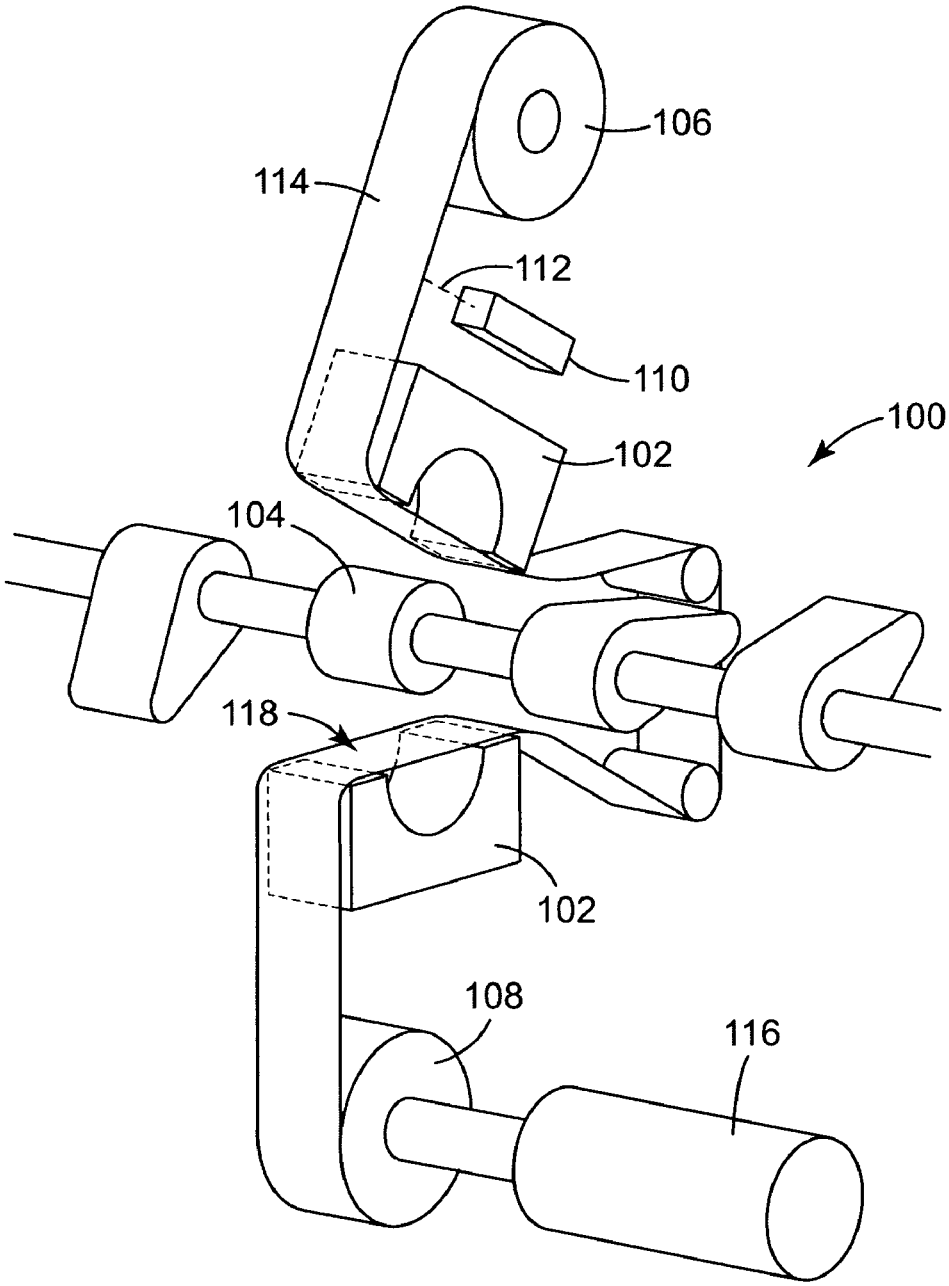
FIG. 1 shows an example of an abrading machine setup including a sensor aimed at the abrading article according to embodiments of the present invention.

FIG. 1 shows one example of an abrading machine configuration. In this example, the abrading machine 100 is abrading a camshaft 104 of an automobile engine. The abrading machine 100 includes an abrading zone 118 where at least one shoe 102 forces an abrading article 114 against the camshaft 104. When the abrading article 114 is installed correctly, the shoe 102 presses on the non-abrasive side of the abrading article to cause the abrasive side to contact and abrade the camshaft 104. The shoe 102 is activated by a controller discussed below in relation to FIG. 2. While two shoes 102 are shown in FIG. 1, it will be appreciated that the number of shoes may vary from machine to machine and that any number of shoes may be utilized to force the article against the workpiece being abraded.

The abrading article 114 extends from a source area where a winder or reel 106 is located to feed the article down through the abrading zone 118 and then extends on to a collection area where the abrading article 114 is received. A second winder or reel 108 is shown as collecting the article, but it will be appreciated that other techniques for collecting the article are also applicable, such as a set of interweaving gears that pull the article. Various rollers may be used to direct the abrading article as necessary through the abrading zone 118 and back to the reels 106, 108. As the portion of the abrading article 114 that is located in the abrading zone 118 becomes worn, a drive motor 116 turns the winder or reel 108 or other collection mechanism by a set amount to incrementally move the abrading article 114. The drive motor 116 is activated by a controller discussed below in relation to FIG. 2.

Abrading machines of this type and others are readily available and may be adapted according to embodiments of the present invention. One example of the abrading machine shown in FIG. 1 is the GBQ 1500 manufactured by Industrial Metal Products Corp. (IMPCO) of Lansing, Mich. However, it will be appreciated by one of skill in the art that this particular abrading machine such as shown in FIG. 1 is disclosed only for purposes of illustration and is not intended to limit the scope of the present invention.

Likewise, the abrading articles used in these abrading machines are also readily available and may be adapted according to embodiments of the present invention. An example of such abrading articles is the 372L Microfinishing Film manufactured by 3M of St. Paul, Minn. This particular film has a very fine grade that is used when a finer finish is desired for a workpiece. Dimensions of the rolls of abrading articles may vary greatly. For example, roll lengths are typically from a few feet (e.g., 1 meter) up to more than 1200 feet (e.g. 365 meters or more), while roll widths (i.e., width of the abrasive tape) are typically from 1 cm to 30 cm.

Details of exemplary rolls of abrading article are discussed below. However, these details are provided only for purposes of illustration and are not intended to limit the present invention to these examples of abrading articles.

The backing of an exemplary roll of abrading article has a front and back surface and can be any conventional abrasive backing. Examples of useful backings include polymeric film, primed polymeric film, cloth, paper, vulcanized fiber, nonwovens, and combinations thereof. Other useful backings include a fibrous reinforced thermoplastic backing as disclosed in U.S. Pat. No. 5,316,812 and an endless seamless backing as disclosed in World Patent Application No. WO 93/12911 published. The backing may also contain a treatment or treatments to seal the backing and/or modify some physical properties of the backing. These treatments are well known in the art.

The abrasive particles of an exemplary roll of abrading article typically have a particle size ranging from about 0.1 to 1500 micrometers, usually between about 0.1 to 400 micrometers, preferably between 0.1 to 100 micrometers and most preferably between 0.1 to 50 micrometers. It is preferred that the abrasive particles have a Mohs' hardness of at least about 8, more preferably above 9. Examples of such abrasive particles include fused aluminum oxide (which includes brown aluminum oxide, heat treated aluminum oxide and white aluminum oxide), ceramic aluminum oxide, green silicon carbide, silicon carbide, chromia, alumina zirconia, diamond, iron oxide, ceria, cubic boron nitride, boron carbide, garnet and combinations thereof.

The abrasive particles are dispersed in an organic binder to form the abrasive coating. The binder is derived from a binder precursor that comprises an organic polymerizable resin. During the manufacture of the inventive abrasive articles, the binder precursor is exposed to an energy source that aids in the initiation of the polymerization or curing process. Examples of energy sources include thermal energy and radiation energy, the latter including electron beam, ultraviolet light, and visible light. During this polymerization process, the resin is polymerized and the binder precursor is converted into a solidified binder. Upon solidification of the binder precursor, the abrasive coating is formed. The binder in the abrasive coating is also generally responsible for adhering the abrasive coating to the backing.

To continuously monitor the abrading article 114 installed on the abrading machine 100, one or more sensors 110 are positioned a set distance from the abrading article 114 in accordance with embodiments of the present invention. In the exemplary configuration shown in FIG. 1, the sensor 110 fires a beam onto a side of the abrading article 114 that is expected to be the non-abrasive side. As discussed below in relation to FIG. 3, the non-abrasive side has various characteristics that distinguish it from the abrasive side. The sensor 110 also receives the reflection of the beam to produce an input signal and then performs one or more analyses of the input signal to generate one or more output signals. These output signals are provided to the controller for the abrading machine 100 to allow for the control of the abrading operation and related alert(s). The analyses and generation of output signals are discussed in more detail below with reference to FIGS. 4–8.

Various sensor configurations may be utilized to sense the abrading article 114 and provide for the analyses and generation of output signals. As shown, one sensor 110 is provided to sense the abrading article 114 as necessary to make one or more determinations. For example, the sensor 114 may be configured only for a single purpose, such as detecting whether the abrading article 114 is installed with the abrasive side facing the appropriate direction. Alternatively, the one sensor 114 may be configured for multiple purposes, such as not only detecting whether the abrading article 114 is installed with the abrasive side facing the appropriate direction, but also detecting whether splicing tape is present, whether the abrading article 114 is moving, and whether the abrading article 114 is the appropriate grade. As another alternative, multiple sensors may be utilized rather than a single sensor where one sensor is dedicated to assisting with one or more determinations while one or more additional sensors are also dedicated to assisting with one or more different determinations.

Various sensor types such as laser based, optical, LED-fiber optic, etc. may also be utilized for these purposes. For example, a laser based sensor may be utilized to sense the characteristics of the abrading article 114 necessary to make the one or more determinations discussed above. Exemplary sensors are models QS30LDL, QC50, and QC50X, all manufactured by Banner Engineering of Minneapolis, Minn. These sensors typically provide a binary output signal value based on performing a determination of whether a sensed input signal value is within tolerance of a reference signal value that has been learned by sensing a known specimen, such as a non-abrasive side of an abrading article. However, it will be appreciated that sensors producing more complex output values are also applicable.

The sensor typically includes an emitter and a receiver. The emitter emits a beam of energy, such as a laser beam, and the reflection is collected by the receiver to produce an input signal value. It has been found that satisfactory input signal values leading to correct analyses are obtained with the Banner laser sensor positioned a distance of three to nine inches from the article. However, other distances may also be applicable and will vary from sensor to sensor.

The effects of lubricants may also be accounted for in the system of FIG. 1. To prevent the lubricant from building up on the lens of the sensor, a low pressure blow off may be continuously or periodically applied to the lens. Additionally, a low pressure blow off may be applied to the laser, and a relatively lengthy pipe for housing the laser may be used to further isolate the laser from the lubricant mist. The abrading article may also be exposed to the lubricant. It has been found that sensing of the abrasive article is still possible even when lubricant has come into contact with the abrading article. However, to help eliminate any negative effects of lubricant on the film, the sensor may be aimed toward an area of the abrading article that has not yet been advanced into the lubricant mist.

Figure 2:
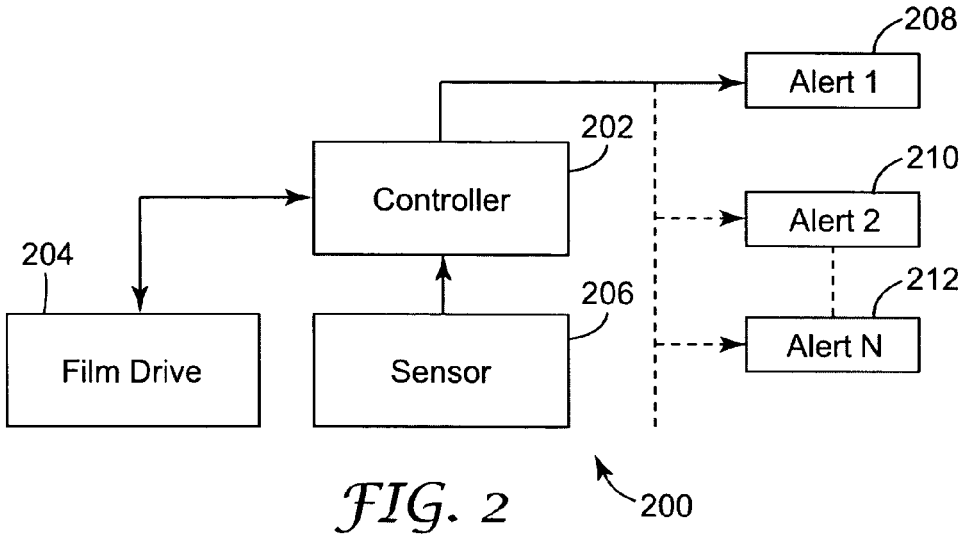
FIG. 2 shows an example of the interconnection of the major components for sensing the article and controlling the abrading machine and alerts according to embodiments of the present invention.

FIG. 2 shows the interconnection of components that make up a control system 200 that allows for the sensing of the abrading article and for the resulting control of abrading operations and/or alert(s). The system 200 includes a sensor 206, such as sensor 110 of FIG. 1, that senses one or more characteristics of the abrading article installed on the abrading machine and performs one or more analyses to produce an output signal value. For example, the sensor 206 may produce an input signal that is a value representing the intensity of the reflection, and the sensor 206 may have learned a value representing a reference intensity that corresponds to no splicing tape being present. The sensor 206 of this example includes logic that compares the input signal value to the reference signal value to generate an output signal value. The output signal value in this example may be binary, a simple high or low voltage, that is provided to a controller 202 to indicate whether splicing tape is present, or may be a more complex signal value including several bits of data or including various analog signal levels or frequencies.

The controller 202 may be a programmable logic device such as that often used to control the operations of abrading machines. However, the controller 202 includes an input(s) for receiving the output signal(s) from the sensor 202. Furthermore, the controller 202 of this example includes an output for each alert 208, 210, 212 that it will activate when appropriate as dictated by the output signal(s) produced by the sensor 206. Thus, the controller 202 recognizes that when a particular output signal being received is either high or low (or of one value versus others if not a single binary value), then the controller 202 will either activate a particular alert associated with that output signal or will allow activation of the abrading operation so that the abrading operation may begin. Where multiple analyses are being performed, the controller will allow activation of the abrading machine only if none of the multiple output signals of the sensor 206 (or multiple sensors, if present) has resulted in the activation of an alert which prohibits the abrading operation.

The alerts 208, 210, 212 may be audible, visible, or other indication type perceivable by an operator. These alerts inform the operator that attention to the machine is required before it will proceed. Where an alert is present for each analysis performed, then the operator may be immediately made aware of the problem. However, it will be appreciated that a single alert 208 may be used for all analyses performed to indicate to the operator that there is some problem. The operator may then visibly analyze the article to determine which problem(s) have occurred.

The controller 202 has input/output communication established with an article drive 204. The article drive 204 includes a drive motor as well as feedback, such as from an encoder, regarding the actual distance that the article drive 204 has moved the article. Accordingly, the controller 202 can activate and deactivate the drive motor of the article drive 204 to move the article by the appropriate increment. Furthermore, the controller 202 may utilize the feedback indicating that the drive motor is advancing the article for embodiments where the article movement is analyzed while the article should be advancing, such as where determining whether the article is broken.

Figure 3A:
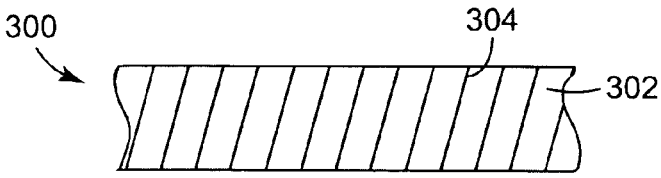
FIG. 3A shows an example of a non-abrasive side of an abrading article that includes index marks.

FIG. 3A shows an example of the non-abrasive side 302 of an abrading article 300. The non-abrasive side of this example includes indexing marks 304 that may be detected by the sensor to produce an input signal(s). For example, when the article is moving, the indexing marks will result in one input signal value, or a repeating set of values such as high, low, high, low. Accordingly, as used herein input signal value may refer to either a single value taken at an instant in time or to a set of values taken over a period of time. Another input signal value will occur if the article is stationary, such as a constant high or a constant low.

It has been found that diagonal indexing marks 304 that span the entire width of the article 300 provide adequate input signals capable of comparison to a reference to determine whether the article is either installed with the abrasive side facing the proper direction and whether the article is moving or stationary. Furthermore, it has been found that the diagonal indexing marks 304 may be given a color dependent upon the grade of the article, and color that have different contrasts may be sensed by the Banner laser sensor to provide adequate input signals capable of comparison to a reference to determine whether the article is the proper grade. For example, with a red laser diode sensor such as the Banner sensor noted above, a white background may be used while green indexing marks represent one grade and black indexing marks represent another grade. Accordingly, both green and black indexing marks can be sensed against the white background to detect whether the abrasive side is facing the proper direction and whether the article is moving. Green and black can also be distinguished relative to one another to allow detection of whether the proper grade article is installed.

Figure 3B:
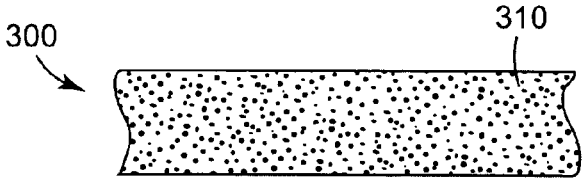
FIG. 3B shows an example of an abrasive side of an abrading article.

FIG. 3B shows an example of an abrasive side 310 of the article 300. The abrasive side 310 is the side intended to contact the workpiece and perform the abrading. The severity of the abrasiveness of side 310 dictates what grade the article is and therefore, what color the indexing marks of the non-abrasive side are. The abrasive side of this example lacks indexing marks such that if the article is installed backwards, no marks are sensed thereby producing an input signal that does not match the reference. As another example, for an abrasive that is semi-transparent the indexing marks may appear on both sides but be sensed with a different level of intensity. Accordingly, a determination can be made as to whether the abrasive is facing the proper direction by comparing the sensed intensity of the indexing marks to a reference intensity.

It will be appreciated that the scenario described above may be reversed as well when detecting whether the abrasive side is facing the appropriate direction. For example, the sensor may be directed toward the side of the article expected to be the abrasive side such that it is expected that the input signal does not indicate that indexing marks are present. Furthermore, the situation may be that indexing marks are provided on the abrasive side rather than the non-abrasive side such that it is expected that the indexing marks will be sensed on the abrasive side to detect whether the abrasive side is facing the proper direction, whether the article is moving, and whether the article is the proper grade.

Figure 3C:
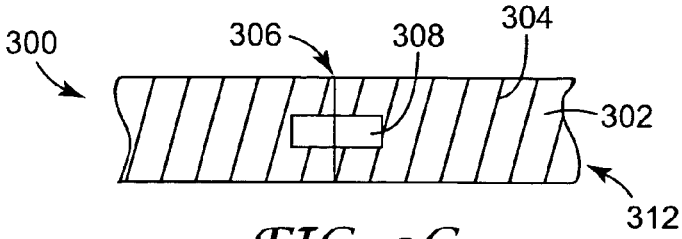
FIG. 3C shows an example of ends of two sections of abrading article held together by splicing tape.

FIG. 3C shows an example of a junction 306 created by the end of one piece of abrading article 300 and the beginning of another piece of abrading article 312. Typically, the operator splices the two pieces together at the junction 306 when the article 300 is nearing its end so that the machine may continue to run without stopping to reload a new roll of article. The junction 306 may either by overlapping or a butt end connection as shown. The ends are spliced together by application of splicing tape 308, typically on both the abrasive side 310 and the non-abrasive side 302.

Splicing tape typically has a higher reflectivity than the article. Therefore, the input signal produced by sensing the area where the splicing tape 308 is located tends to saturate the sensor to produce an input signal that can be differentiated from a reference signal corresponding to the absence of splicing tape 308. As noted above, this situation may be reversed as well where the reference corresponds to the saturation produced by the splicing tape such that a failure to match the reference indicates the absence of splicing tape.

Figure 4:
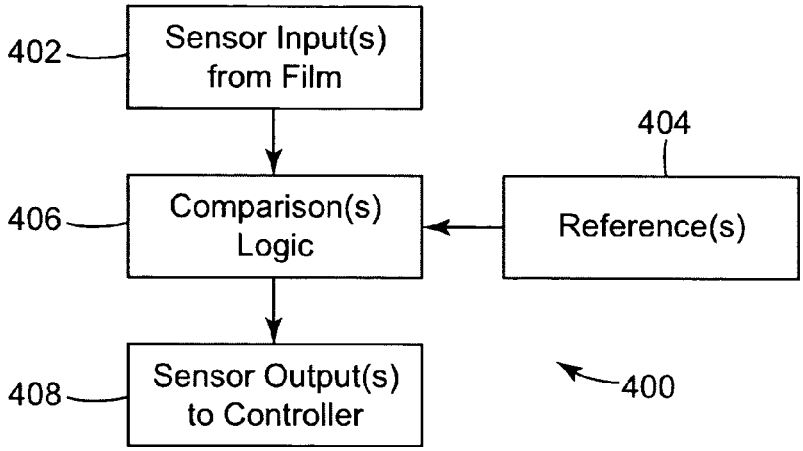
FIG. 4 shows an example of components of a sensor according to embodiments of the present invention.

FIG. 4 shows the configuration 400 of logic of the sensor used to produce an output signal used by the controller. The sensor includes one or more sensor inputs 402 produced by the receiver(s) of the sensor collecting the reflection of the beam from the article. The sensor inputs provide the input signal(s) to comparison logic 406. The sensor also includes some form of storage of a reference 404. For example, where the input signal is bits of data, then the reference is stored as bits of data in digital memory and the comparison logic performs a comparison between the two sets of digital data. The input signal may also be an analog signal, and the reference 404 is also a reproduction of an analog signal that is provided for an analog comparison by logic 406. In either instance, comparison logic 406 generates an output 408 that provides an output signal to the controller.

As discussed above, the output signal may be binary per analysis performed or a more complex signal or set of signals. As one example, the sensor may be configured with a reference for each comparison to be performed by the logic 406. The sensor output 208 then provides an output for each comparison. The controller may then activate individual and dedicated alerts based on the results of the comparisons. Alternatively, the output 208 may generate a single output signal to the controller that indicates that either all analyses were acceptable or that one or more were unacceptable so that the controller may then activate a generic alert.

Figure 5:
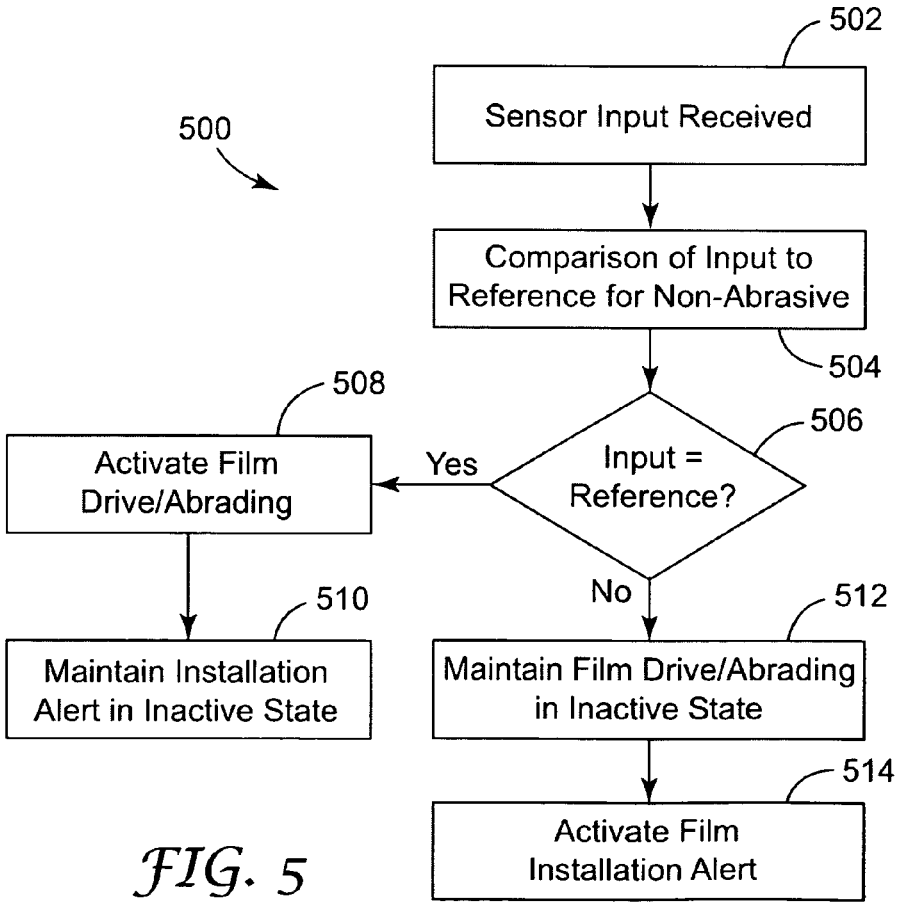
FIG. 5 shows the logical operations performed by the components of FIG. 2 in relation to determining whether the abrasive side of the article is facing the appropriate direction.

FIG. 5 shows the set 500 of logical operations that may be performed by the sensor and controller to control the abrading operations and alerts based on sensing the characteristics of the abrading article installed on the abrading machine. Specifically, FIG. 5 corresponds to the detection and subsequent control based on whether the abrasive side of the article is facing the appropriate direction. The logical operations begin at input operation 502 where the sensor receives the reflection of the beam as input to generate a corresponding input signal value. At comparison operation 504, the input signal value is compared to the appropriate reference value indicative of the non-abrasive side of the article (or alternatively indicative of the abrasive side). At query operation 506, it is determined whether the result of the comparison is that the input signal value is within a specified tolerance relative to the reference value such that they are substantially equal or not. The specified tolerance may be determined empirically for a given installation including the particular article, particular sensor, distance of article to sensor, etc. Thus, query operation 506 is performed by the controller receiving the output signal and determining which value it has.

Upon detecting that the input is equal to the reference from the output signal value, where the reference is for the non-abrasive side and the side expected to be the non-abrasive side is the side being sensed, then operational flow transitions to activation operation 508. Here, the controller activates the article drive and abrading for normal operation. Activation operation 508 assumes that there is no other reason to halt the initiation of the article drive and abrading, such as where this is the only analysis that has been performed or because all other analyses are satisfactory as well. Additionally, at this time at alert operation 510, the controller maintains the article installation alert in an inactive state.

Returning to query operation 506, if the controller determines from the output signal value that the input signal does not equal the reference, meaning that the abrasive side is facing the wrong direction (where the reference equals the non-abrasive side), then operational flow transitions to inaction operation 512. Here the controller maintains (or transitions) the article drive and abrading operations in an inactive state to prevent the abrading machine from applying the non-abrasive side of the abrading article to the workpiece. Concurrently, the controller activates an alert, such as an installation alert that is specifically indicative of the article being installed backwards or a general alert that is indicative of some problem rather than the specific one, at activation operation 514. The alert, such as a blinking light or an audible sound, is intended to get the attention of an operator who may then reinstall the abrading article with the abrasive facing the proper direction so that abrading operations may continue.

Figure 6:
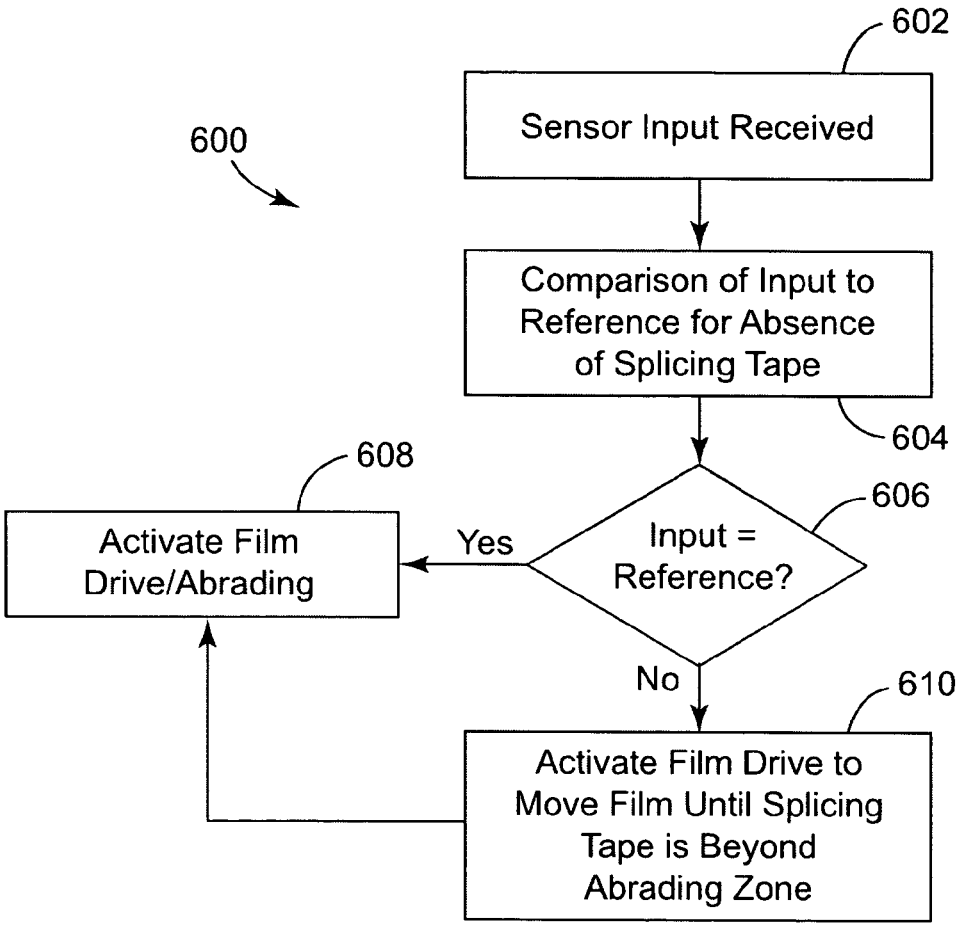
FIG. 6 shows the logical operations performed by the components of FIG. 2 in relation to determining whether splicing tape is present within an abrading zone.

FIG. 6 shows another set 600 of logical operations that may be performed by the sensor and controller to control the abrading operations based on sensing the characteristics of the abrading article installed on the abrading machine. Specifically, FIG. 6 corresponds to the detection and subsequent control based on whether splicing tape is detected. The logical operations begin at input operation 602 where the sensor receives the reflection of the beam as input to generate a corresponding input signal value. At comparison operation 604, the input signal value is compared to the appropriate reference value indicative of the absence of splicing tape (or alternatively indicative of the presence of splicing tape). At query operation 606, it is determined whether the result of the comparison is that the input signal value is within a specified tolerance relative to the reference value such that they are substantially equal or not. Again, the specified tolerance may be determined empirically for a given installation including the particular article, particular splicing tape, particular sensor, distance of article to sensor, etc. Thus, query operation 606 is performed by the controller receiving the output signal and determining which value it has.

Upon detecting that the input is equal to the reference from the output signal value, where the reference is for the absence of splicing tape, then operational flow transitions to activation operation 608. Here, the controller activates the article drive and abrading to begin or continue normal operation. Activation operation 608 assumes that there is no other reason to halt the initiation of the article drive and abrading, such as where this is the only analysis that has been performed or because all other analyses are satisfactory as well.

Returning to query operation 606, if the controller determines from the output signal value that the input signal does not equal the reference, meaning that the splicing tape is present (where the reference equals the absence of splicing tape), then operational flow transitions to move operation 610. At move operation 610, the controller instructs the article drive to move the abrading article by an amount necessary to move the splicing tape beyond the abrading zone and stops abrading operations during this movement by moving the shoe away from the workpiece to prevent the abrading machine from applying the splicing tape to the workpiece. This amount may be a pre-defined amount that is known to move the splicing tape from the area being sensed to beyond the abrading zone. After the splicing tape has transitioned beyond the abrading zone, operational flow transitions to activation operation 608, discussed above. Although not shown, the controller may also activate an alert that is specifically indicative of the article being moved to avoid the splicing tape, while move operation 610 is being performed or as an alternative to move operation 610. This alert may be provided to inform an operator that the machine is moving the article a distance larger than a normal movement as a purposeful event, rather than a malfunction. This alert may also signal the presence of splicing tape that requires manual intervention as an alternative to move operation 610.

Figure 7:
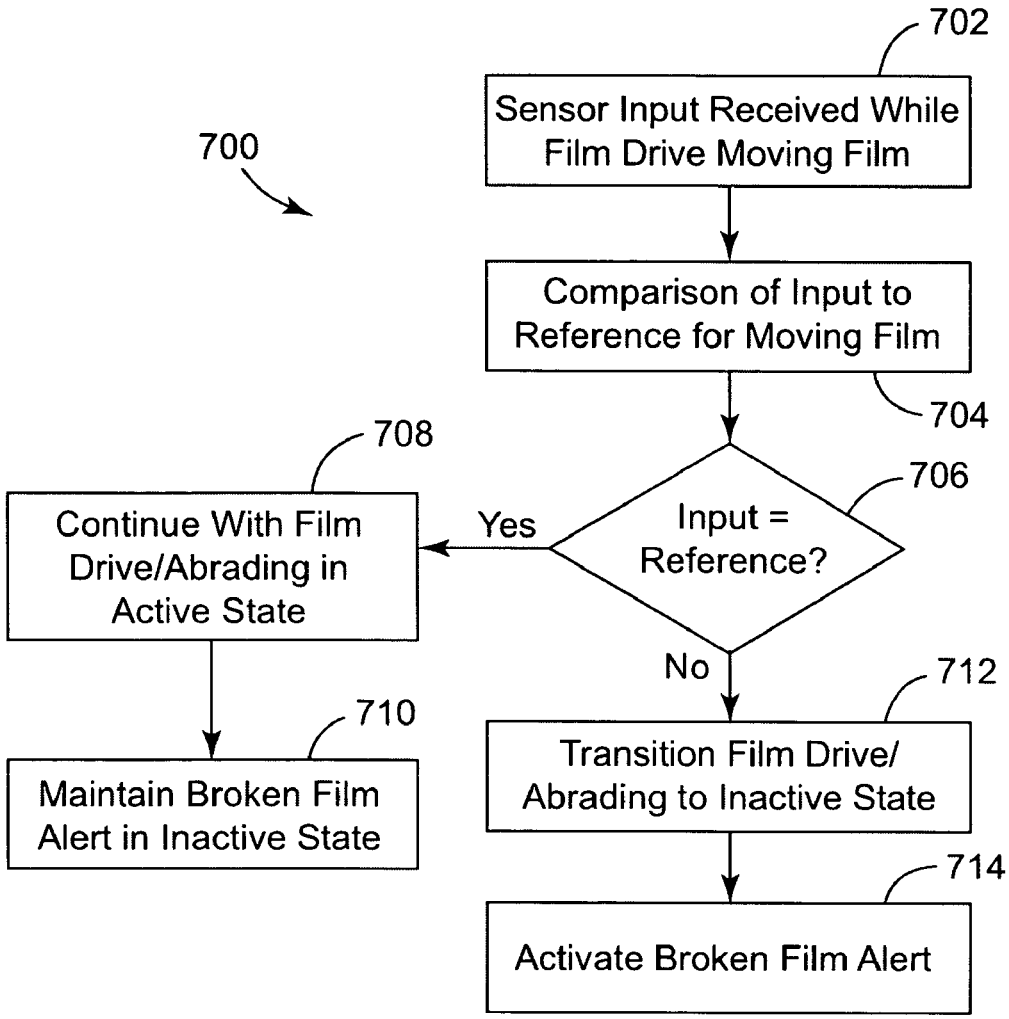
FIG. 7 shows the logical operations performed by the components of FIG. 2 in relation to determining whether the abrading article has broken.

FIG. 7 shows another set 700 of logical operations that may be performed by the sensor and controller to control the abrading operations and alerts based on sensing the characteristics of the abrading article installed on the abrading machine. Specifically, FIG. 7 corresponds to the detection and subsequent control based on whether the abrading article has broken. The logical operations begin at input operation 702 where the sensor receives the reflection of the beam as input to generate a corresponding input signal value. This analysis is performed while the controller has instructed the article drive to advance the article since the reference value for the comparison expects the article to be in motion. At comparison operation 704, the input signal value is compared to the appropriate reference value indicative of the abrading article in motion and therefore not broken (or alternatively indicative of the abrading article not moving and therefore broken). At query operation 706, it is determined whether the result of the comparison is that the input signal value is within a specified tolerance relative to the reference value such that they are substantially equal or not. Again, the specified tolerance may be determined empirically for a given installation including the particular article and index markings, particular sensor, distance of article to sensor, etc. Thus, query operation 706 is performed by the controller receiving the output signal and determining which value it has.

Upon detecting that the input is equal to the reference from the output signal value, where the reference is for the article in motion and therefore not broken, then operational flow transitions to activation operation 708. Here, the controller activates the article drive and abrading for normal operation. Activation operation 708 assumes that there is no other reason to halt the initiation of the article drive and abrading, such as where this is the only analysis that has been performed or because all other analyses are satisfactory as well. Additionally, at this time at alert operation 710, the controller maintains the breakage alert in an inactive state.

Returning to query operation 706, if the controller determines from the output signal value that the input signal does not equal the reference, meaning that the article is broken because it is not moving (where the reference equals the article in motion), then operational flow transitions to inaction operation 712. Here the controller transitions the article drive and abrading operations to an inactive state to prevent the abrading machine from applying the abrading article to the workpiece while it is broken. Concurrently, the controller activates an alert, such as a breakage alert that is specifically indicative of the article being broken or a general alert that is indicative of some problem rather than the specific one, at activation operation 714. The alert, such as a blinking light or an audible sound, is intended to get the attention of an operator who may then splice the broken portion of the abrading article so that abrading operations may continue.

Figure 8:
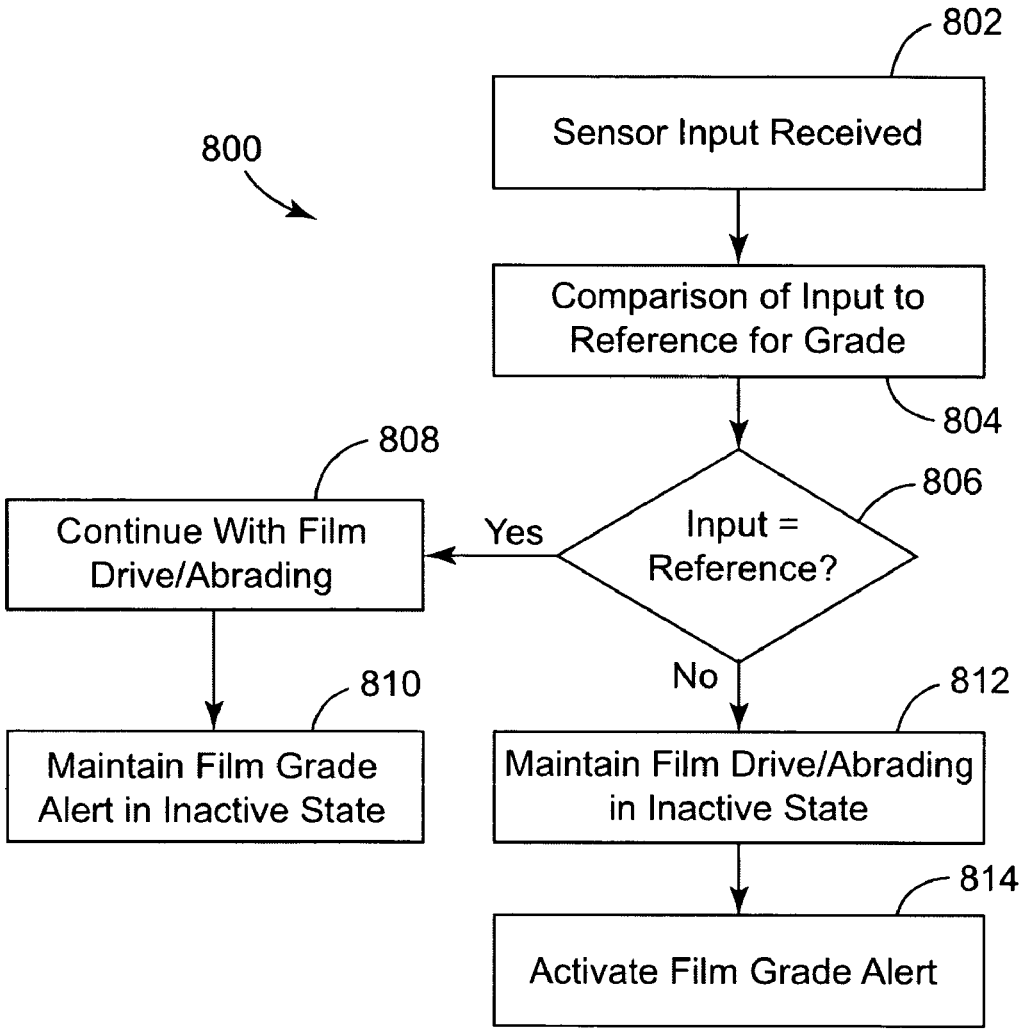
FIG. 8 shows the logical operations performed by the components of FIG. 2 in relation to determining whether the abrading article is the appropriate grade.

FIG. 8 shows another set 800 of logical operations that may be performed by the sensor and controller to control the abrading operations and alerts based on sensing the characteristics of the abrading article installed on the abrading machine. Specifically, FIG. 8 corresponds to the detection and subsequent control based on whether the abrading article is the appropriate grade. The logical operations begin at input operation 802 where the sensor receives the reflection of the beam as input to generate a corresponding input signal value. At comparison operation 804, the input signal value is compared to the appropriate reference value indicative of the appropriate grade of the article (or alternatively indicative of an inappropriate grade). At query operation 806, it is determined whether the result of the comparison is that the input signal value is within a specified tolerance relative to the reference value such that they are substantially equal or not. The specified tolerance may be determined empirically for a given installation including the particular article, particular sensor, distance of article to sensor, etc. Thus, query operation 806 is performed by the controller receiving the output signal and determining which value it has.

Upon detecting that the input is equal to the reference from the output signal value, where the reference is for the appropriate grade, then operational flow transitions to activation operation 808. Here, the controller activates the article drive and abrading for normal operation. Activation operation 808 assumes that there is no other reason to halt the initiation of the article drive and abrading, such as where this is the only analysis that has been performed or because all other analyses are satisfactory as well. Additionally, at this time at alert operation 810, the controller maintains the article grade alert in an inactive state.

Returning to query operation 806, if the controller determines from the output signal value that the input signal does not equal the reference, meaning that the abrading article is the wrong grade (where the reference represents the appropriate grade), then operational flow transitions to inaction operation 812. Here, the controller maintains (or transitions) the article drive and abrading operations in an inactive state to prevent the abrading machine from applying the wrong grade of abrading article to the workpiece. Concurrently, the controller activates an alert, such as an article grade alert that is specifically indicative of the article being an inappropriate grade or a general alert that is indicative of some problem rather than the specific one, at activation operation 814. The alert, such as a blinking light or an audible sound, is intended to get the attention of an operator who may then install the correct grade abrading article so that abrading operations may continue.

Figure 9:
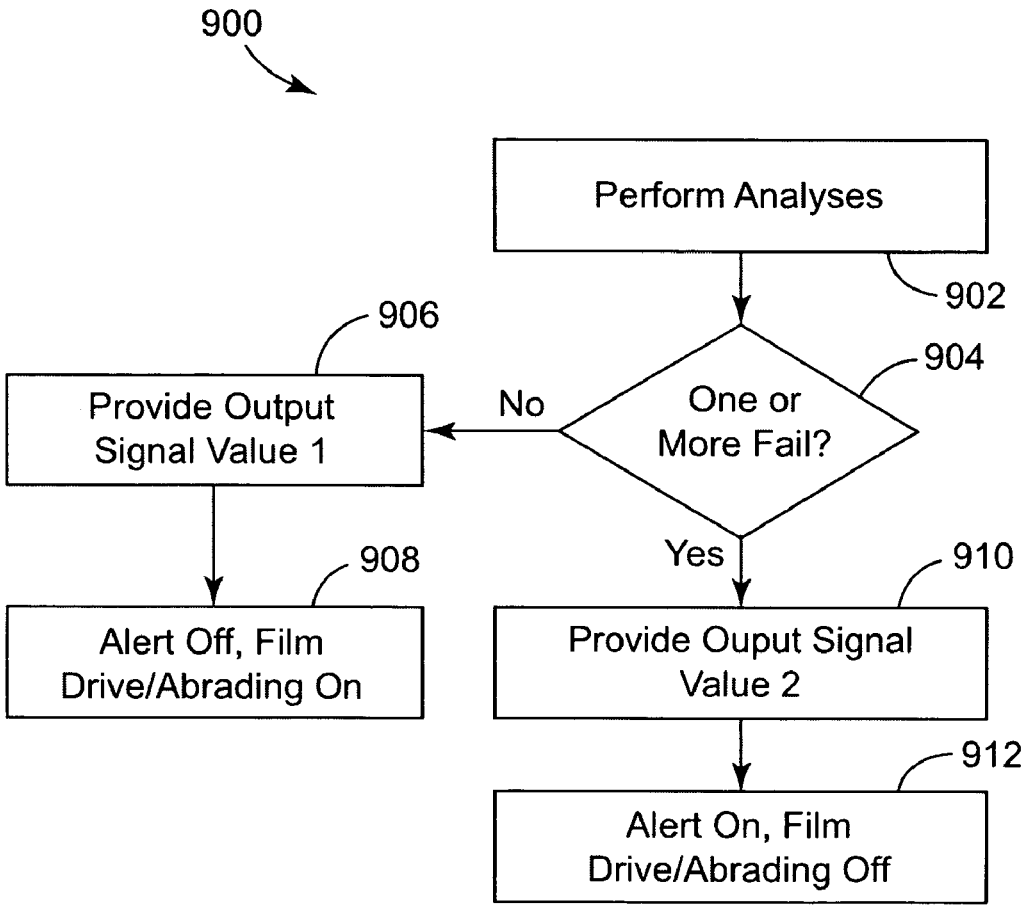
FIG. 9 shows the logical operations performed by the components of FIG. 2 where the sensor consolidates multiple analyses into a single output signal acted upon by the controller.

FIG. 9 shows an example of the logical operations 900 that may occur where the sensor logic performs multiple analyses relative to multiple reference values but consolidates the results to generate a single output signal. Thus, a controller with a single input and alert may properly respond to the multiple analyses by being responsive to a single output signal value. At analysis operation 902, the sensor performs the multiple analyses, such as determining whether the input signal matches the references for the abrasive facing the proper direction, the article being unbroken, and the article being the proper grade. At query operation 904, the sensor then detects whether either of these analyses fail due to the input signal not matching the reference.

When none of the analyses indicate a failure, then the sensor provides an output signal having a first value which the controller interprets as an indication of no problems at output operation 906. The controller then responds to the first output signal value by maintaining a general alert in an inactive or off state and activating the article drive and abrading operations at controller operation 908. When one or more of the analyses indicate a failure at query operation 904, then the sensor provides an output signal having a second value that the controller interprets as an indication of a problem at output operation 910. The controller then responds to the second output signal value by activating the general alert and maintaining or transitioning the article drive and abrading operations to an inactive state at controller operation 912.

Figure 10:
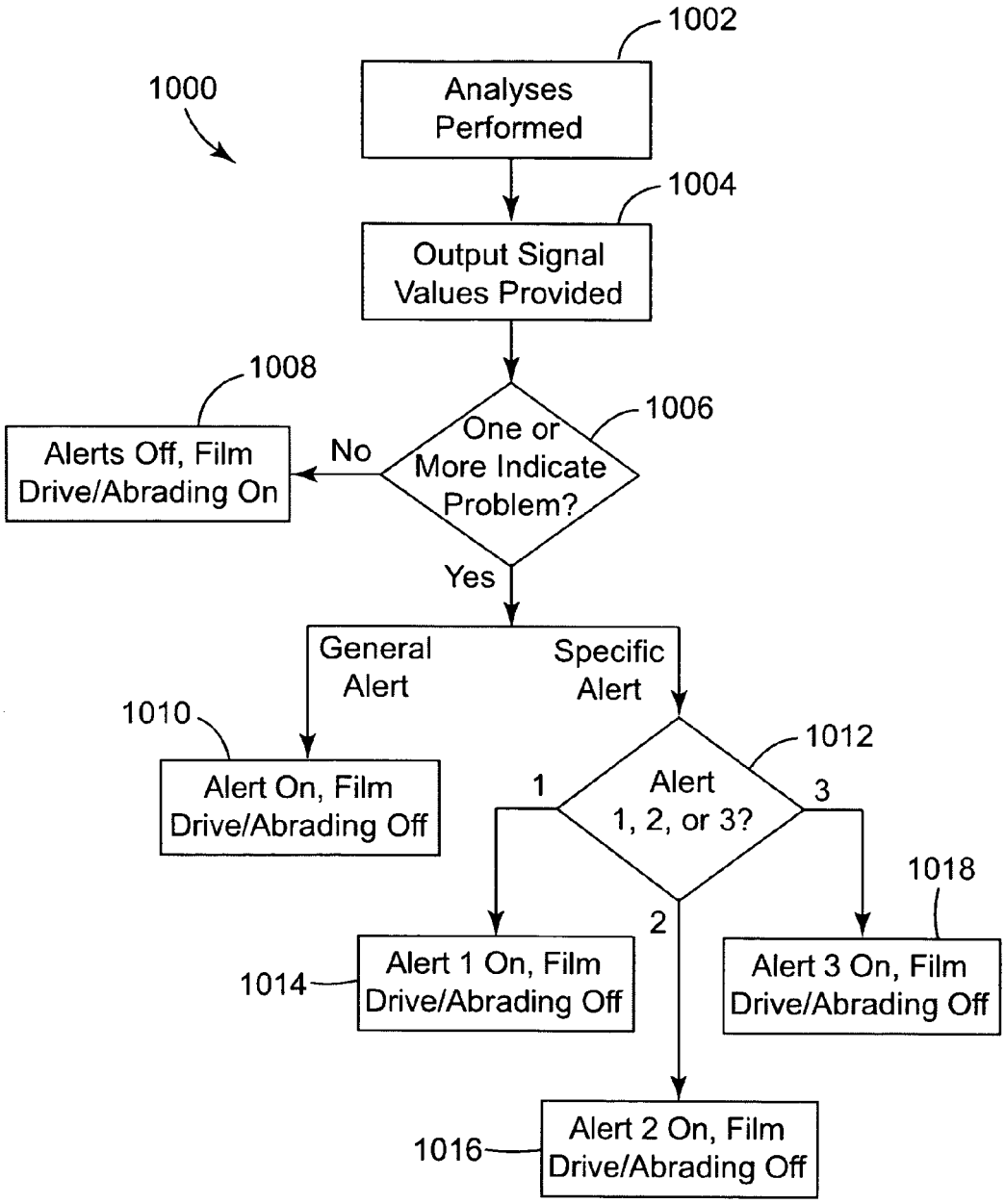
FIG. 10 shows the logical operations performed by the components of FIG. 2 where the sensor(s) provide multiple output signals and the controller receives and acts upon the multiple output signals.

FIG. 10 shows an example of the logical operations 1000 that may occur where one or more sensors perform analyses relative to multiple references to generate multiple output signals. The controller may then either consolidate the output signals to control a general alert or may act upon each output signal to control individual alerts. The analyses relative to the reference values are performed by the sensor (s) at analysis operation 1002. The sensor(s) then generate an output signal for each analysis performed at output operation 1004. At query operation 1006, the controller then detects whether any of the output signals indicates a problem, such as by having a value that indicates the abrasive side is facing the wrong direction, the article is broken, and/or that the article is the wrong grade.

When the controller detects that none of the output signals indicates a problem, then the controller maintains the general alert or all of the specific alerts in an inactive or off state and activates the article drive and abrading operations at controller operation 1008. When the controller detects that one or more of the output signals indicates a problem, then operational flow proceeds depending upon whether there is a general alert to consolidate the results of the analyses or whether there is a specific alert for each analysis.

When there is a general alert to consolidate the analyses, then the controller activates the general alert while maintaining the article drive and abrading operations in an inactive or off state at controller operation 1010. When there are specific alerts, then the controller determines which alert to activate at query operation 1012 based on which output signals are indicative of a problem. As shown, it is presumed that the controller is receiving three output signals. Where the output signal for alert one indicates a problem, then the controller activates alert one while maintaining the article drive and abrading operations in an inactive state at controller operation 1014. Where the output signal for alert two indicates a problem, then the controller activates alert two while maintaining the article drive and abrading operations in an inactive state at controller operation 1016. Likewise, where the output signal for alert three indicates a problem, then the controller activates alert three while maintaining the article drive and abrading operations in an inactive state at controller operation 1016. It will be appreciated that one, two, or all three controller operations 1012, 1014, and 1016 may be performed concurrently when multiple problems co-exist.

While the invention has been particularly shown and described with reference to various embodiments thereof, it will be understood by those skilled in the art that various other changes in the form and details may be made therein without departing from the spirit and scope of the invention.

What is claimed is:

1. A system for controlling an abrading operation by detecting whether an abrading article is installed on an abrading machine with an abrasive side of the abrading article facing an appropriate direction, comprising:

a sensor that is aimed toward the abrading article installed on the abrading machine and that receives a reflection from a first side of the abrading article to produce an input signal value that varies depending upon whether the first side includes a plurality of individually spaced index markings that are visible prior to first use and are indicative of whether the first side is the abrasive side, the sensor comprising logic that analyzes the input signal value in relation to a reference signal value and that produces an output signal having a value determined by a result of the comparison; and a controller that maintains the abrading machine in an active or inactive state and that maintains an alert in an active or inactive state, wherein the alert is indicative of the abrasive side of the abrading article facing an inappropriate direction, wherein the controller receives the output signal and activates the abrading machine from an inactive state while maintaining the alert in the inactive state when the output signal value indicates that the abrasive side is facing the appropriate direction, and wherein the controller activates the alert from the inactive state while maintaining the abrading machine in the inactive state when the output signal value indicates that the abrasive side is not facing the appropriate direction.

2. The system of claim 1, wherein the output signal value is binary and indicates that the abrasive side of the abrading article is facing the appropriate direction when the input signal value is substantially equal to the reference signal value.

3. The system of claim 1, wherein the output signal value is binary and indicates that the abrasive side of the abrading article is not facing the appropriate direction when the input signal value is substantially equal to the reference signal value.

4. The system of claim 1, wherein the abrading article is an abrasive article comprising a plurality of abrasive particles adhered to a film backing.

5. The system of claim 1, wherein the abrading article comprises index marks in the form of diagonal lines on a side of the abrading article.

6. The system of claim 1, further comprising a workpiece having an outer surface, and wherein the abrading article abrades the outer surface of the workpiece.

7. The system of claim 6, wherein the workpiece is an engine component.

8. The system of claim 1, further comprising:

a source area from which the abrading article is unwound; and a collection area to which the abrading article is rewound.

9. A method for controlling an abrading operation based on whether an abrasive side of an abrading article is facing an appropriate direction, comprising:

sensing a reflection from the first side of the abrading article installed on an abrading machine to produce an input signal value that varies depending upon whether the first side includes a plurality of individually spaced index markings that are visible prior to first use and are indicative of whether the first side is the abrasive side;

comparing the input signal value to a reference signal value to determine whether the abrasive side is facing the appropriate direction;

when it is determined that the abrasive side is facing the appropriate direction, maintaining an alert that is indicative of the abrading article being installed with the abrasive side facing an inappropriate direction in an inactive state while activating the abrading machine from an inactive state; and when it is determined that the abrasive side is not facing the appropriate direction, maintaining the abrading machine in the inactive state while activating the alert from the inactive state.

10. The method of claim 9, wherein comparing the input signal value to the reference signal value produces an output signal value, and wherein the output signal value provides an indication of whether the abrasive side is facing the appropriate direction.

11. The method of claim 10, wherein the output signal value is binary and indicates that the abrasive side of the abrading article is facing the appropriate direction when comparing the input signal value to the reference signal value results in the input signal value being substantially equal to the reference signal value.

12. The method of claim 10, wherein the output signal value is binary and indicates that the abrasive side of the abrading article is not facing the appropriate direction when comparing the input signal value to the reference signal value results in the input signal value being substantially equal to the reference signal value.

13. The method of claim 9, wherein the abrading article is an abrasive article comprising a plurality of abrasive particles adhered to a film backing.

14. The method of claim 9, wherein the abrading article comprises index marks on a side of the abrading article.

* * * * *

UNITED STATES PATENT AND TRADEMARK OFFICE

CERTIFICATE OF CORRECTION

PATENT NO. : 7,090,560 B2
APPLICATION NO. : 10/900714
DATED : August 15, 2006
INVENTOR(S) : Daniel A. Billig It is certified that error appears in the above-identified patent and that said Letters Patent is hereby corrected as shown below:

Title Page
Item [75], Inventor:, delete MI and insert -- MN -- therefor.
Page 2, Item [56], References Cited, OTHER PUBLICATIONS, last item listed, delete "10/900862" and insert -- 10/900882 -- therefor.

Column 14
Line 59, in Claim 9, after "from" delete "the" and insert -- a -- therefor.

Signed and Sealed this

Twenty-fourth Day of October, 2006

JON W. DUDAS
*Director of the United States Patent and Trademark Office*